United States Patent [19]

Marchesi

[11] Patent Number: 4,554,840

[45] Date of Patent: Nov. 26, 1985

[54] ANTI-WOBBLE DEVICE FOR A CONNECTING ROD

[75] Inventor: Franco Marchesi, Pavia, Italy

[73] Assignee: Rockwell-Rimoldi S.p.A., Milan, Italy

[21] Appl. No.: 643,574

[22] Filed: Aug. 23, 1984

[30] Foreign Application Priority Data

Feb. 28, 1984 [IT] Italy ..... 19823 A/84

[51] Int. Cl.[4] ..... F16H 21/52; D05B 57/02

[52] U.S. Cl. ..... 74/42; 112/199; 112/220

[58] Field of Search ..... 74/42; 112/199, 200, 112/220

[56] References Cited

U.S. PATENT DOCUMENTS

| | | | |
|---|---|---|---|
| 1,641,135 | 8/1927 | Clayton | 112/200 |
| 2,351,831 | 6/1944 | Muecke | 112/199 |
| 3,145,672 | 8/1964 | Marforio | 112/199 |
| 4,022,140 | 5/1977 | Lienemann | 112/220 |

FOREIGN PATENT DOCUMENTS 527691 6/1955 Italy .

*Primary Examiner*—Lawrence J. Staab

[57] ABSTRACT

An anti-wobble device for a connecting rod (3) in a mechanism comprising a crankshaft (1) connected via a spherical coupling (4) to the larger end (5) of the said connecting rod (3), the smaller end (6) of which is connected via a similar spherical coupling (7) to an arm (8) fixed to a driven shaft (9), the axis of which is perpendicular to the axis of the crankshaft (1), in which device, a rigid element (13–16) is integrally and perpendicularly mounted on the driven shaft (9), with respect to which it can also be adjusted both axially and radially; this rigid element makes contact with a curved surface (12) formed on the small end (6) of the connecting rod (3) and concentric with respect to the axis of the said small end (6) of the connecting rod (3), against which surface the said element can rub in a parallel manner during the movements of the mechanism.

5 Claims, 4 Drawing Figures

ANTI-WOBBLE DEVICE FOR A CONNECTING ROD

DESCRIPTION

The present invention relates to an anti-wobble device for a connecting-rod in a mechanism comprising a crankshaft connected via a spherical coupling to the larger end of the connecting rod, the smaller end of which is connected via a similar spherical coupling to an arm fixed to an oscillating driven shaft, the axis of which is perpendicular to the axis of the crankshaft. The said device is advantageously used on industrial sewing machines in which, specifically, the oscillating driven shaft transmits the movement to a hook in order to form the switch.

A type of anti-wobble device is already known, comprising a guiding U-piece which is fixed at one of its ends to the small end of the connecting rod, whereas the other end is located inside a seating which is parallel to the axis of the connecting rod and is formed in the spherical end of the arm coupled to the said connecting rod, as described in the Italian Pat. No. 527,691.

This anti-wobble device, however, possesses the major defect that the said seating is subjected to very great wear and becomes deformed, all of which is caused by the fact that the connecting rod, which describes a circle together with its own crankshaft, inclines the guiding U-piece which is integral with the connecting rod itself, whereas the arm oscillates around the axis of the driven shaft so that the seating is displaced in linear fashion, whereas the U-piece rotates with its end in the seating, which is thus deformed on account of the wear.

Thus the play which is created between the seating and the U-piece causes inevitable wobbling of the connecting rod with respect to the spherical coupling of the arm and hence the mechanism becomes noisy on account of the continual knocking of the connecting rod during the abovementioned wobbling. This can even lead to the U-piece breaking and to subsequent replacement of the same end of the entire arm with the spherical head and rectilinear seating. The continual oscillations of the U-piece in its seating causes stresses in the connection between the end of the U-piece and the small end of the connecting rod, thereby causing loosening of the screw which fixes the said end to the connecting rod or breakage of the latter.

The object and technical problem of the present invention consist in producing a anti-wobble device for the connecting rod, without the abovementioned defects.

Figure 3:
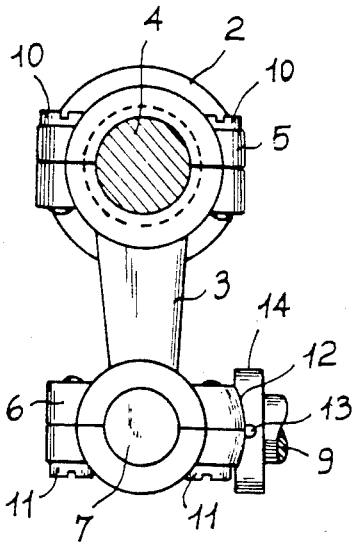
Figure 2:
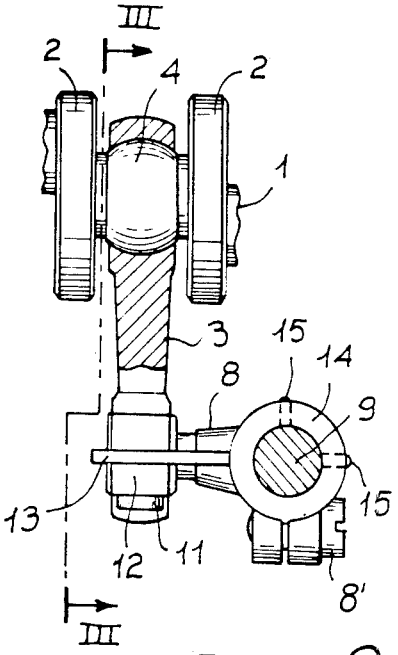
Figure 1:
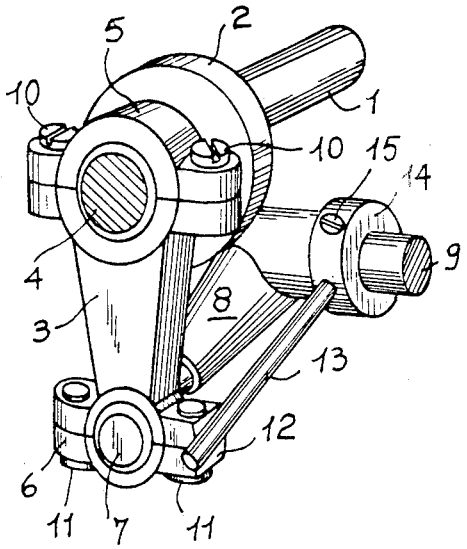
Figure 4:
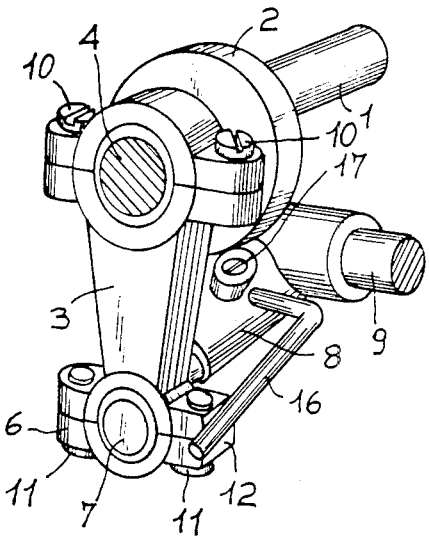

The solution of this technical problem consists in a device which has the characteristics contaned in the claims relating to the description which follows, given purely by way of a non-limiting example of the scope of the present invention and illustrated in the attached drawings, in which:

FIG. 1 shows a perspective view of the device in question according to a first embodiment, FIG. 2 shows the device of FIG. 1, partially sectioned, FIG. 3 is the section according to the line III—III of FIG. 2, and, FIG. 4 shows a perspective view of the device n question according to another embodiment.

The Figures show the shaft 1 with the crank 2 to which the connecting rod 3 is coupled by means of the spherical coupling 4 engaged in the larger end 5 of the connecting rod itself, the smaller end 6 of which is connected via a similar spherical coupling 7 to the arm 8 fixed by means of the screw 8' to the driven shaft 9, the axis of which is at 90° to the axis of the shaft 1.

The two parts forming the finger end 5 of the connecting rod 3 are kept closed by means of the screws 10, and, similarly, the two parts forming the smaller end 6 of the same connecting rod 3 are kept closed by means of the screws 11.

The smaller end 11 is shaped according to a curved surface 12 which is concentric with respect to the axis of the small end itself. Parallelly in contact with the said curved surface 12 there is a rigid element which is integral with the driven shaft 9, with respect to which it is also oriented at 90°.

The said rigid element performs an oscillatory movement integrally with the said driven shaft during the movements of the mechanism described above.

As a result of these movements, the rigid element rubs against the said curved surface 12 and prevents the connecting rod 3 from assuming imperfectly aligned positions with respect to both the shaft 1 and the driven shaft 9.

In a first embodiment of the present invention, the above-mentioned rigid element is provided in the form of a rod 13 inserted in a detachable manner in the bush 14 which is in turn fixed to the driven shaft 9 by means of screws 15.

The driven shaft 9 can be coupled with any element, which oscillates precisely about the axis of the said shaft; this elememt can be, for example, a hook, as illustrated in the Figures of the Italian Pat. No. 527,691.

Operation of this device is simple since, when the shaft 1 rotates, the connecting rod 3 oscillates together with the arm 8 so that the rod 13 follows these movements of the connecting rod, advantageously preventing the latter from wobbling, with the minimum of wear between the rod 13 and the curved surface 12, the relative movement between the said parts making contact being minimal. Another advantage is that any play between the surface 12 and the rod 13 is eliminated by means of the easy adjustment of the position of the bush 14 on the shaft 9, both axially and radially.

The above-described embodiment of the invention, however, does not permit accurate assessment of the amount of pressure which is generated between the curved surface 12 and the rod 13 when the components are being mounted on the machine or after adjustment of the position of the bush 14 with respect to the arm 8.

For this reason, the rigid element according to the invention can be advantageously provided also in the form of a bracket 16 which is directly mounted on the arm 8 and fixed there by means of a screw 17, as illustrated in FIG. 4.

It can be easily understood that this bracket 16 fulfils the same operating requirements as the rod 13, with the further advantage that it allows the operator to adjust the pressure between the curved surface 12 and the rigid element even before they are mounted on the machine.

In fact, when the connecting rod 3 is coupled to the spherical head 7 of the arm 8, the operator can already position the bracket 16 with respect to the curved surface 12, in the manner required.

The bracket 16 is mounted on the arm 8 so that it is parallel to the axis of the latter with the end rubbing agianst the curved surface 12, and perpendicularly to this axis with the part which is inserted and fixed in the arm itself.

Therefore, by simply loosening the screw 17, it is possible to adjust the position of the bracket 16 with respect to all the components of the mechanism.

Breakages of these systems described above are almost impossible, but even if this were to happen, only the rod 13 or the bracket 16 would have to be replaced.

A few preferred embodiments of the present invention have been described above. However, the latter can be modified and varied without going beyond the scope of the invention itself.

I claim:

1. An anti-wobble device for a connecting rod that joins a crankshaft to an arm fixed to an oscillating driven shaft whose axis is oriented 90° with respect to the axis of the crankshaft, the joints at each end of the crankshaft having spherical mating surfaces, said anti-wobble device comprising a rigid element secured at one end for oscillation with the driven shaft and contacting the joint connecting the connecting rod to the arm at the other end, and means for adjusting said rigid element both radially and axially with respect to the driven shaft.

2. A device as defined in claim 1 wherein the joint connecting the connecting rod to the arm has a curved outer surface formed on one side thereof.

3. An anti-wobble device as claimed n claim 2, wheren the said element consists of a rod inserted in a bushing in a detachable manner and wherein the said bushing is in turn mounted on the driven shaft whre it is fixed in an adjustable manner by means of screws.

4. An anti-wobble device as claimed in claim 1, wherein said rigid element consists of a bracket having one part which is parallel to the said arm and at its end makes contact with the joint connecting the connecting rod to the arm and one part which is substantially perpendicular to said arm, said perpendicular part being mounted on the arm in an adjustable manner.

5. An anti-wobble device as defined in claim 2 wherein said arm makes contact with the curved surface on the joint connecting the connecting rod to the arm.

* * * * *